US007042314B2

(12) United States Patent
Wang et al.

(10) Patent No.: US 7,042,314 B2
(45) Date of Patent: May 9, 2006

(54) DIELECTRIC MONO-BLOCK TRIPLE-MODE MICROWAVE DELAY FILTER

(75) Inventors: Chi Wang, Holmdel, NJ (US); Weili Wang, Old Bridge, NJ (US); William D. Wilber, Jackson, NJ (US); William D. Blair, Freehold, NJ (US)

(73) Assignee: Radio Frequency Systems, Meriden, CT (US)

( * ) Notice: Subject to any disclaimer, the term of this patent is extended or adjusted under 35 U.S.C. 154(b) by 13 days.

(21) Appl. No.: 10/277,971

(22) Filed: Oct. 23, 2002

(65) Prior Publication Data

US 2003/0090344 A1 May 15, 2003

Related U.S. Application Data

(63) Continuation-in-part of application No. 09/987,353, filed on Nov. 14, 2001.

(51) Int. Cl.
*H01P 1/20* (2006.01)
*H01P 1/208* (2006.01)
*H01P 7/10* (2006.01)

(52) U.S. Cl. ..... 333/202; 333/219.1; 333/209

(58) Field of Classification Search ..... 333/208, 333/209, 210, 219.1, 219, 202
See application file for complete search history.

(56) References Cited

U.S. PATENT DOCUMENTS 4,431,977 A 2/1984 Sokola et al.
4,607,242 A 8/1986 Cozzie
4,614,920 A 9/1986 Tong
4,675,630 A 6/1987 Tang
4,691,179 A 9/1987 Blum et al.

(Continued)

FOREIGN PATENT DOCUMENTS

EP 0742603 A 11/1996

(Continued)

OTHER PUBLICATIONS

Wang, C et al.: "A Practical Triple-Mode MonoBlock Bandpass Filter for Base Station Applications" 2001 IEEE MTT-S International Microwave Symposium Digest (IMS 2001), Phoenix, AZ, May 20-25, 2001, IEEE MTT-S International Microwave Symposium, New York, NY: IEEE, US, vol. 3 of 3, May 20, 2001, pp. 1783-1786, XP001067566.

(Continued)

*Primary Examiner*—Stephen E. Jones
(74) *Attorney, Agent, or Firm*—Sughrue Mion, PLLC; TTom Gellenthien; V. Lawrence Sewell

(57) ABSTRACT

A delay filter uses the dielectric mono-block triple-mode resonator and unique inter-resonator coupling structure, having smaller volume and higher power handling capacity. The triple-mode mono-block resonator has three resonators in one block. An input/output probe is connected to each metal plated dielectric block to transmit microwave signals. Corner cuts couple a mode oriented in one direction to a mode oriented in a second, mutually orthogonal direction. An aperture between two blocks couples all six resonant modes, and generates two inductive couplings by magnetic fields between two modes, and one capacitive coupling by electric fields. The input/output probes, coupling corner cuts and aperture are aligned such that all six resonators are coupled in the desired value and sign, so constant delay on the transmitted signal within certain bandwidth can be achieved. By connecting the input and output probes to the base printed circuit board, the delay filter is surface mountable.

9 Claims, 8 Drawing Sheets

U.S. PATENT DOCUMENTS

| | | | | |
|---|---|---|---|---|
| 5,083,102 | A | 1/1992 | Zaki | |
| 5,325,077 | A | 6/1994 | Ishikawa et al. | |
| 5,589,807 | A | 12/1996 | Tang | |
| 5,783,979 | A | 7/1998 | Andoh et al. | |
| 5,821,837 | A | 10/1998 | Accatino et al. | |
| 5,859,574 | A | 1/1999 | Schmitt | |
| 5,926,079 | A | 7/1999 | Heine et al. | 333/208 |
| 6,020,800 | A * | 2/2000 | Arakawa et al. | 333/208 |
| 6,081,175 | A | 6/2000 | Duong et al. | |
| 6,275,125 | B1 | 8/2001 | Takei et al. | |
| 6,356,170 | B1 | 3/2002 | Aralawa et al. | |
| 6,359,534 | B1 | 3/2002 | Hunter | |
| 6,484,043 | B1 | 11/2002 | Klein et al. | |
| 6,507,254 | B1 | 1/2003 | Hattori et al. | |
| 6,535,086 | B1 | 3/2003 | Liang et al. | |
| 6,552,628 | B1 | 4/2003 | Jang | |
| 6,556,106 | B1 | 4/2003 | Sano | |
| 6,563,397 | B1 | 5/2003 | Jang | |
| 6,853,271 | B1 | 2/2005 | Wilber et al. | |
| 2001/0000656 | A1 | 5/2001 | Arakawa et al. | |
| 2001/0028287 | A1 | 10/2001 | Matsumoto et al. | |
| 2002/0003461 | A1 | 1/2002 | Hunter | |
| 2002/0041221 | A1 | 4/2002 | Abdulnour | |
| 2002/0093395 | A1 | 7/2002 | Jang | |
| 2002/0186103 | A1 | 12/2002 | Ando et al. | |
| 2003/0090343 | A1 | 5/2003 | Wilber et al. | |
| 2003/0117244 | A1 | 6/2003 | Matsuura et al. | |
| 2005/0128031 | A1 | 6/2005 | Wilber | |

FOREIGN PATENT DOCUMENTS

| | | | |
|---|---|---|---|
| EP | 1 122 807 | A | 8/2001 |
| EP | 1313164 | A2 | 5/2003 |
| EP | 1265313 | A2 | 12/2003 |
| JP | 406177607 | A | 6/1994 |
| JP | 09148810 | * | 6/1997 |

OTHER PUBLICATIONS

Patent Abstracts of Japan, vol. 1997, No. 10, Oct. 31, 1997 JP 09-148810 A.

Mattes, M et al.: "Six-Pole Triple Mode Filters in Rectangular Waveguide" Microwave Symposium Digest 2000 IEEE MTT-2 International Boston, MA, USA Jun. 11-16, 2000, Piscataway, NJ, USA, IEEE, US, Jun. 11, 2000, pp. 1775-1778, XP010507203.

Abstract of JP402016801A, Jan. 19, 1990, Koichi Uzawa "Triple Mode Dielectric Filter".

Abstract of JP02001060804A, Mar. 6, 2001, Saiko Ko, et al., "Dielectric Resonator and Dielectric Filter".

Abstract of JP02001060805A, Mar. 6, 2001, Atsushi Furuta, et al., "Dielectric Resonator and Dielectric Filter".

Design of Microwave Dielectric Resonators, J.C. Sethares, et al., IEEE Transaction on Microwave Theory and Techniques, vol. MTT-14, No. 1, Jan. 1966, pp. 2-7.

CAD of Triple-Mode Cavities in Rectangular Waveguide, Lastoria, et al. IEEE Microwace and Guided Wave Letters, vol. 8, No. 10, Oct. 1998.

Triple Mode Filters with Coaxial Excitation, Gerini, et al., 0-7803-5687-X/00/S10.00 (c) 2000 IEEE, pp. 1-4.

Dual Mode Coupling by Square Corner Cut in Resonators and Filters, Liang, IEEE Transaction on Microwave Theory and Techniques, vol. 40, No. 12, Dec. 1992.

A True Elliptic-Function Filter Using Triple-Mode Degenerate Cavities, Wai Cheung Tang, et al., IEEE Transactions on Microwave Theory and Techniques, vol. MTT-32 No. 11, Nov. 1984.

Six-Pole Triple Mode Filters In Rectangular Waveguide, Mattes, et al., European Space Research and Technology Center (ESTEC), pp. 1-4, 2000 IEEE.

Dual-Mode Dielectric or Air-Filled Rectangular Waveguide Filters, Liang, et al., IEEE Transactions on Microwave Theory and Techniques, vol. 42, No. 7, Jul. 1994.

Application of the Planar I/O Terminal to Dual Mode Dielectric Waveguide Filters, Sano, et al., 0-7803-5687-X/00/$10.00(c) 2000 IEEE.

Cavity and Surface-mount Delay Line Filters for Feedforward Power Amplifiers, K & L Microwave, Inc., Sep. 1999, pp. 1-5.

The Website for Mobile Communications EMC Technology, Inc. RF Resistive Products, Attenuators, Power Sensing Terminations, Thermopads and Delay Lines, http://www.mobilecomms-technology.com/contractors/electronic-components/emc, Aug. 2, 2002.

MDP Microwave Pfoducts Digest, Sep. 2001, Variable Delay Lines Enhance Feedforward Power Amplifiers and Bypass Applications, Lilly, et al.http://www.mpdigest.com/Articles/Sept2001/etenna/Default.htm.

Using Resonated Couplings in Filters, RS Microwave Technology Center, May 1997, http://rf.rfglobalnet.com/library/ProductNotes/files /6/5-97tec.htm.

Tunable Combline Filter Using 60 Degree Resonators, Kurzrok, Applied Microwave & Wireless, pp. 98, 100.

Generalized Multi-layer Combline and Dielectric Loaded Resonators for CAD of High Performande Base Station Filters, Wang, et al., Progress in Electromagnetics REsearch Symposium, Jul. 5-14, 2000, Cambridge, MA, USA.

TEM Mode Dielectric Combline, FSY Microwave, Inc., http://www.fsmicrowave.com/temcomb.htm, Aug. 2, 2002.

Spurious Couplings Degrade Badpass Filter Performance, Kurzrok, et al., MWRF Oct. 1999, http://www.microwavesrf.com/Globals/ PlanetEE/dsp/article.cfm.

Technical Glossary, Basic Terminology for Quartz Crystal Resonaors, http://www.4timing.com/termcrystal. htm, Aug. 2, 2002.

Microwaves, Metal and Arcing, Excerpts from the book The Complete Microwave Oven Service Handbook http://www.gallawa.com/microtech/metal_arc.html©1999.

Tikhov et al, "A Novel Surface Mount Filter Based on a Triple-Mode Ceramic Cavity", Radio and Wireless Conference, 2001, RAWCON 2001, IEEE, Aug. 19-22, 2001, pp. 161-164.

Isota Y, et al, "A Grooved Monoblock Comb-Line Filter Suppressing the Third Hamonies" IEEE MTT-S International Microwave Symposium Digest, Las Vegas, Jun. 9-11, 1987, International Microwave Symposium, New York, IEEE, US, vol. 1, Jun. 9, 1987, pp. 383-386 XP002030374.

Liang et al, "Dual Mode Dielectric or Air-Filled Rectangular Waeguide Filters, " IEEE Transactions on Microwave Theory and Techniques, vol. 42, No. 7, Jul. 1994.

* cited by examiner

DIELECTRIC MONO-BLOCK TRIPLE-MODE MICROWAVE DELAY FILTER

This is a continuation-in-part application of application Ser. No. 09/987,353 filed Nov. 14, 2001, the disclosure of which is incorporated herein by reference.

BACKGROUND OF THE INVENTION

1. Field of the Invention

This invention relates to filter assemblies. More particularly, this invention discloses triple-mode, mono-block resonators that are smaller and less costly than comparable metallic combline resonators, including a microwave flat delay filter.

2. Background of the Invention

When generating signals in communication systems, combline filters are used to reject unwanted signals. Current combline filter structures consist of a series of metallic resonators dispersed in a metallic housing. Because of the required volume for each resonator, the metallic housing cannot be reduced in size beyond current technology, typically 3–10 cubic inches/resonator, depending on the operating frequency and the maximum insertion loss. Furthermore, the metallic housing represents a major cost percentage of the entire filter assembly. Consequently, current metallic filters are too large and too costly.

Further, personal communication systems demand highly linearized microwave power amplifiers for base station applications. Feedforward techniques are commonly used in the power amplifier design for reducing the level of the intermodulation distortion (IMD). One component common to feedforward power amplifier design is the delay in the primary high power feedforward loop for canceling the error signals of the power amplifier (PA). The electric delay is typically achieved by the coaxial type transmission line or metallic resonator filter. A filter-based delay line can be thought of as a specially designed wide bandpass filter with optimized group delay However, the related art has various problems and disadvantages. For example, but not by way of limitation, because of the required volume for the delay line/filter for the new generation communication systems, the coaxial line and metallic housing filter cannot be further reduced in size limited by maximum insertion loss.

SUMMARY OF THE INVENTION

In a preferred embodiment, the invention is a method and apparatus of providing a very flat group delay over a wide frequency range.

In another preferred embodiment, the invention is a method and apparatus of tuning a filter assembly comprising a block resonator filter by removing small circular areas of a conductive surface from a face of said block resonator filter.

In still another preferred embodiment, the invention is a method and apparatus of tuning a filter assembly comprising a block resonator filter by grinding areas on a plurality of orthogonal faces of said block resonator filter to change the resonant frequencies of modes in said block.

In still another preferred embodiment, the invention is a method and apparatus of tuning a filter assembly comprising a block resonator filter by using at least one tuning cylinder among a plurality of orthogonal faces of said block resonator filter to tune said filter.

BRIEF DESCRIPTION OF THE DRAWINGS

FIG. 1*b* is a view showing a probe inserted into the mono-block.

DETAILED DESCRIPTION OF THE INVENTION

It is desirable to reduce the size and cost of the filter assemblies beyond what is currently possible with metallic combline structures which are presently used to attenuate undesired signals. The present invention incorporates triple-mode resonators into an assembly that includes a mask filter and a low pass filter such that the entire assembly provides the extended frequency range attenuation of the unwanted signal.

The assembly is integrated in a way that minimizes the required volume and affords easy mounting onto a circuit board.

Triple-Mode Mono-Block Cavity

Filters employing triple-mode mono-block cavities afford the opportunity of significantly reducing the overall volume of the filter package and reducing cost, while maintaining acceptable electrical performance. The size reduction has two sources. First, a triple-mode mono-block resonator has three resonators in one block. (Each resonator provides one pole to the filter response). This provides a 3-fold reduction in size compared to filters currently used which disclose one resonator per block. Secondly, the resonators are not air-filled coaxial resonators as in the standard combline construction, but are now dielectric-filled blocks. In a preferred embodiment, they are a solid block of ceramic coated with a conductive metal layer, typically silver. The high dielectric constant material allows the resonator to shrink in size by approximately the square root of the dielectric constant, while maintaining the same operating frequency. In a preferred embodiment, the ceramic used has a dielectric constant between 35 and 36 and a Q of 2,000. In another embodiment, the dielectric constant is 44 with a Q of 1,500. Although the Q is lower, the resonator is smaller due to the higher dielectric constant. In still another preferred embodiment, the dielectric constant is 21 with a Q of 3,000.

Furthermore, because the mono-block cavities are self-contained resonators, no metallic housing is required. The cost reduction from eliminating the metallic housing is greater than the additional cost of using dielectric-filled resonators as opposed to air-filled resonators.

The concept of a mono-block is not new. However, this is the first triple-mode mono-block resonator. In addition, the ability to package the plated mono-block triple-mode resonator filled with low loss, high dielectric constant material into a practical filter and assembly is novel and unobvious.

Figure 1A:
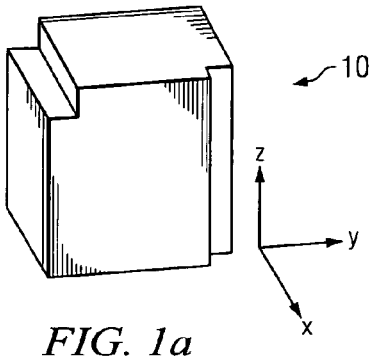
FIGS. 1*a* and 1*b* are two views of the fundamental triple-mode mono-block shape.
Figure 1B:
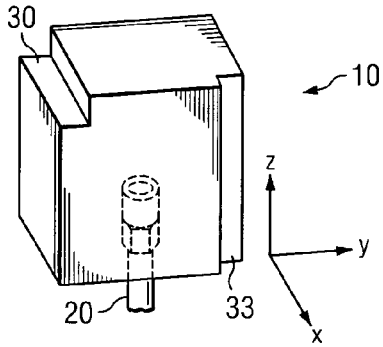

The basic design for a triple-mode mono-block resonator 10 is shown in FIG. 1 in which two views 1(*a*) and 1(*b*) are shown of the fundamental triple-mode mono-block shape. It is an approximately cubic block. The three modes tat are excited are the TE110, TM101 and TE011 modes. See J. C. Sethares and S. J. Naumann. "Design of Microwave Dielectric Resonators," IEEE Trans. Microwave Theoxy Tech., pp. 2–7, January 1966, hereby incorporated by reference. The three modes are mutually orthogonal. The design is an improvement to the triple-mode design for a rectangular (hollow) waveguide described in G. Lastoria, G. Gerini, M. Guglielmi and F. Emma, "CAD of Triple-Mode Cavities in Rectangular Waveguide," IEEE Trans. Microwave Theory Tech., pp. 339–341, October 1998, hereby incorporated by reference.

The three resonant modes in a triple-mode mono-block resonator are typically denoted as TE011, TM101, and TE110 (or sometimes as TE11□, TM1□1, and TE 1□1), where TE indicates a transverse electric mode, TM indicates a transverse magnetic mode, and the three successive indices (often written as subscripts) indicate the number of half-wavelengths along the x, y and z directions.

Corner Cuts

The input and output power is coupled to and from the mono-block 10 by a probe 20 inserted into an input/output port 21 in the mono-block 10 as seen in FIG. 1(*b*). The probe can be part of an external coaxial line, or can be connected to some other external circuit. The coupling between modes is accomplished by corner cuts 30, 33. One is oriented along the Y axis 30 and one is oriented along the Z axis 33. The two corner cuts are used to couple modes 1 and 2 and modes 2 and 3. In addition to the corner cuts shown in FIG. 1, a third corner cut along the X axis can be used to cross-couple modes 1 and 3.

Figure 2:
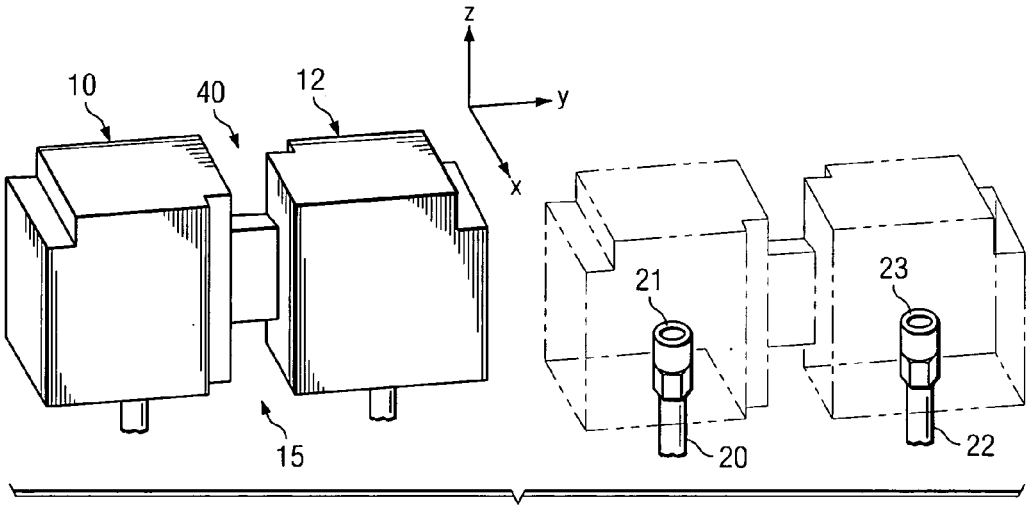
FIG. 2 is a solid and wire-frame view of two mono-blocks connected together to form a 6-pole filter.

FIG. 2 is a solid and a wire-frame view showing two of the triple-mode mono-blocks connected together 10, 12 to form a six-pole filter 15 (each triple-mode mono-block resonator has 3 poles). A connecting aperture or waveguide 40 links windows in each of the blocks together. The aperture can be air or a dielectric material. The input/output ports 21, 23 on this filter are shown as coaxial lines connected to the probes 20, 22 (see FIG. 1) in each block 10, 12.

Corner cuts 30, 33 are used to couple a mode oriented in one direction to a mode oriented in a second mutually orthogonal direction. Each coupling represents one pole in the filter's response. Therefore, the triple-mode mono-block discussed above represents the equivalent of three poles or three electrical resonators.

Figure 3A:
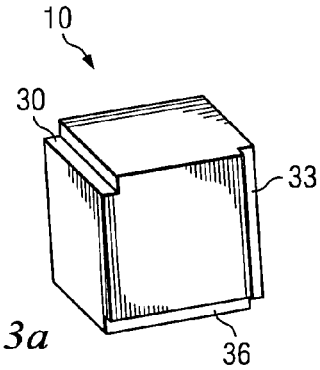
FIGS. 3*a* and 3*b* are solid and wire-frame views of the mono-block with a third corner cut.
Figure 3B:
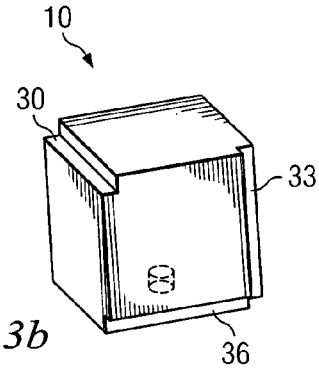

FIG. 3 shows a third corner cut 36 (on the bottom for this example) that provides a cross coupling between modes 1 and 3 in the mono-block. A solid block is shown in part 3(*a*) and a wire frame view is shown in 3(*b*). By the appropriate choice of the particular block edge for this corner cut, either positive or negative cross coupling is possible.

Tuning

Tuning: Like most other high precision, radio frequency filters, the filter disclosed here is tuned to optimize the filter response. Mechanical tolerances and uncertainty in the dielectric constant necessitate the tuning. The ability to tune, or adjust, the resonant frequencies of the triple-mode mono-block resonator 10 enhances the manufacturability of a filter assembly that employs triple-mode mono-blocks as resonant elements. Ideally, one should be able to tune each of the three resonant modes in the mono-block independently of each other. In addition, one should be able to tune a mode's resonant frequency either higher or lower.

Four novel and unobvious methods of tuning are disclosed. The first tuning method is to mechanically grind areas on three orthogonal faces of the mono-block 10 in order to change the resonant frequencies of the three modes in each block. By grinding the areas, ceramic dielectric material is removed, thereby changing the resonant frequencies of the resonant modes.

This method is mechanically simple, but is complicated by the fact that the grinding of one face of the mono-block 10 will affect the resonant frequencies of all three modes. A computer-aided analysis is required for the production environment, whereby the affect of grinding a given amount of material away from a given face is known and controlled.

Figure 4:
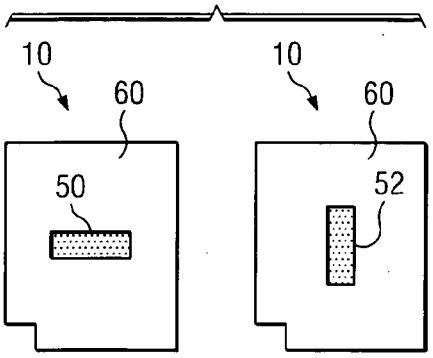
FIG. 4 illustrates a slot cut within a face of the resonator.
Figure 5:
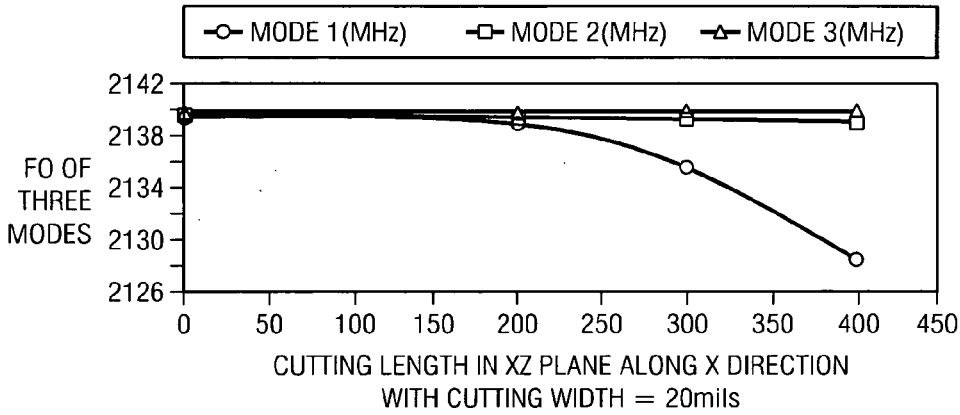
FIG. 5 is a graph of resonant frequencies of Modes 1, 2 and 3 vs. cutting length for a slot cut along the X-direction on the X-Z face.
Figure 6:
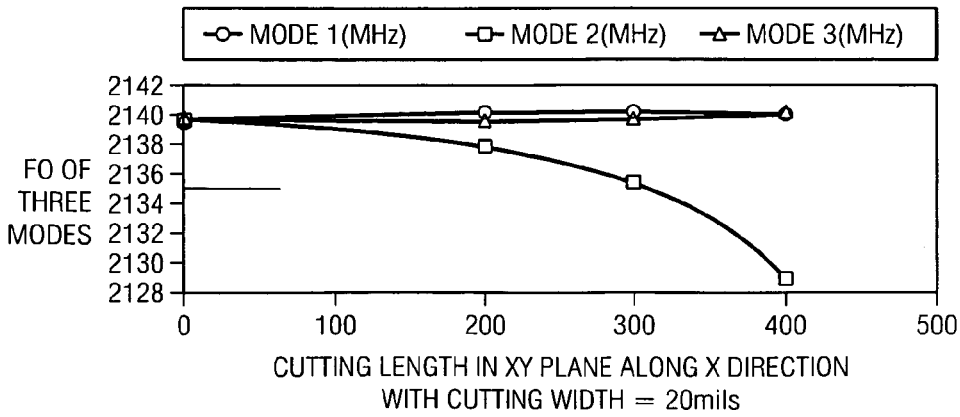
FIG. 6 is a graph of resonant frequencies of Modes 1, 2 and 3 vs. cutting length for a slot cut along the X-direction on the X-Y face.
Figure 7:
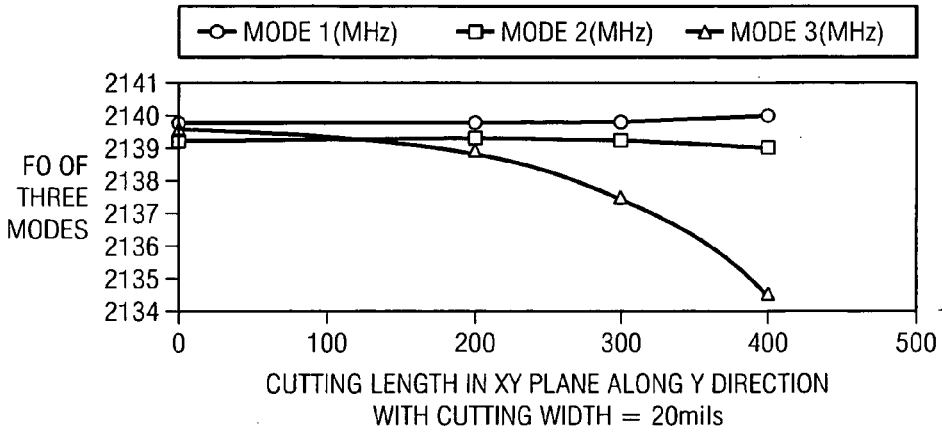
FIG. 7 is a graph of resonant frequencies of Modes 1, 2 and 3 vs. cutting length for a slot cut along the Y-direction on the X-Y face.
Figure 8A:
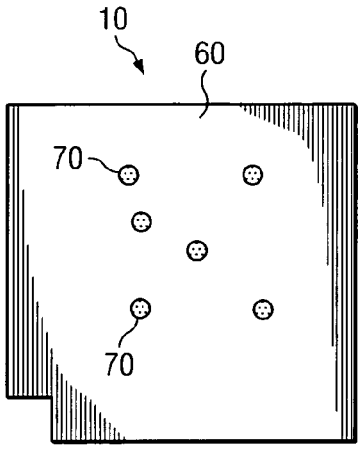
FIG. 8*a* illustrates a method of tuning the mono-block by removing small circular areas of the conductive surface from a particular face of the mono-block.
Figure 8B:
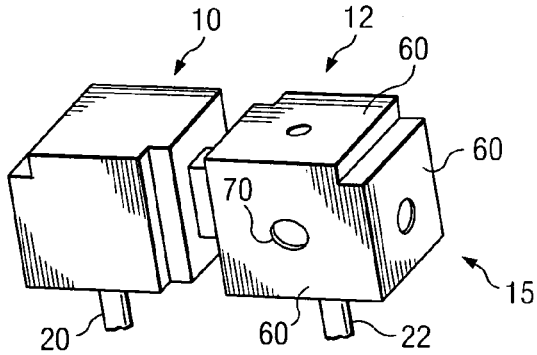
FIG. 8*b* illustrates tuning resonant frequencies of the three modes in the block using indentations or circles in three orthogonal sides.
Figure 9:
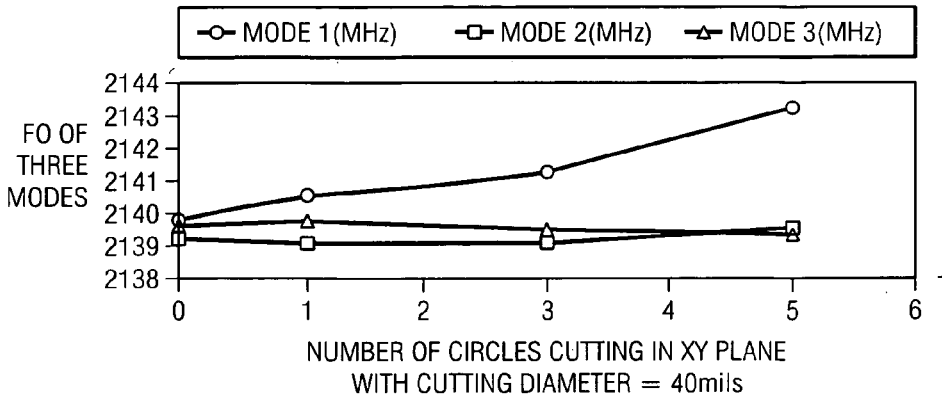
FIG. 9 is a graph showing the change in frequency for Mode 1 when successive circles are cut away from the X-Y face of the mono-block.

Another method of tuning frequency is to cut a slot 50, 52 within a face 60 of the resonator 10 (see FIG. 4). By simply cutting the proper slots 50, 52 in the conductive layer, one can tune any particular mode to a lower frequency. The longer the slot 50, 52, the greater the amount that the frequency is lowered. The advantage behind using this conductive surface from a particular face (or plane) of the mono-block 10 (see FIGS. 8*a* and *b*). FIG. 9 shows the change in frequency for Mode 1 when successive circles 70 (diameter=0.040 inches) close to the face center are cut away from the X-Y face (or plane) 60 of the mono-block 10. In a similar fashion, one can tune Mode 2 to a higher frequency by removing small circles 70 of metal from the X-Z face (or plane) 60, and one can tune Mode 3 to higher frequency by the same process applied to the Y-Z face (or plane) 60. Note that, in FIG. 9, Modes 2 and 3 are relatively unchanged while the frequency of Mode 1 increases. The depth of the hole affects the frequency. Once again, only the frequency of one of the coupled modes is affected using this method. The resonant frequency of the other two modes is unaffected. The metal can be removed by a number of means including grinding, laser cutting, chemically etching. electric discharge machining or other means. FIG. 8(*b*) shows the use of three circles (or indentations) 70 on three orthogonal faces 60 of one of two triple-mode mono-blocks 10, 12 connected together.

They are used to adjust the resonant frequencies of the three modes in the one block 12. Tuning for only one block is shown in this figure. Tuning for the second block (the one on the left) 10 would be similar.

Figure 10A:
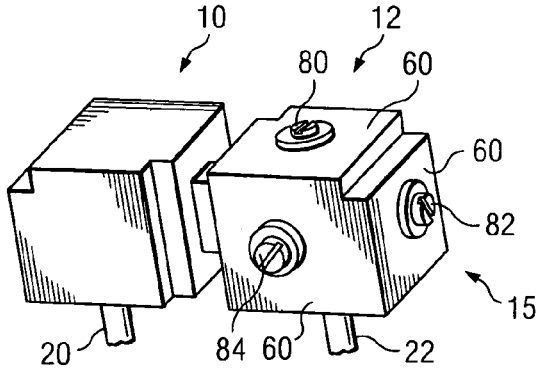
FIGS. 10*a* and *b* illustrate tuning resonant frequencies of the three modes in the block using metallic or dielectric tuners attached to three orthogonal sides (FIG. 10*a*), or metallic or dielectric tuners protruding into the mono-block (FIG. 10*b*).
Figure 10B:
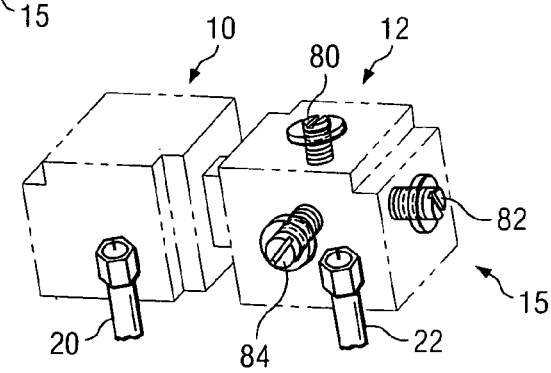
Figure 11A:
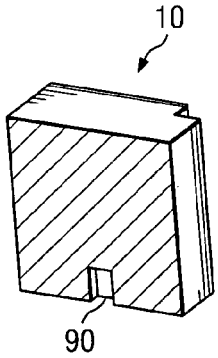
FIGS. 11*a, b, c* and *d* illustrate a method for the input/output coupling for the triple-mode mono-block filter.
Figure 11B:
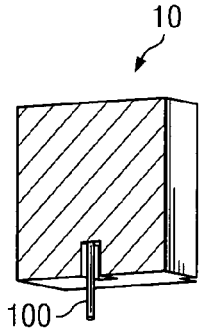
Figure 11C:
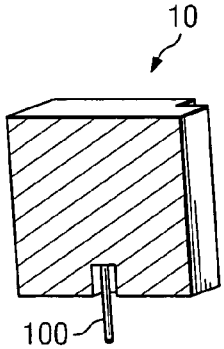
Figure 11D:
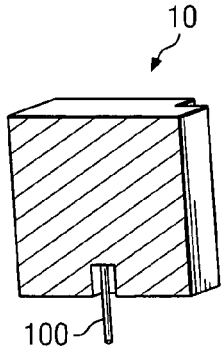

The fourth tuning method disclosed here is the use of discrete tuning elements or cylinders 80, 82, 84. FIGS. 10(*a*) and 10(*b*) show the 3 elements 80, 82, 84 distributed among three orthogonal faces 60 of the mono-block 10, to affect the necessary change of the resonant frequencies. FIG. 10(*a*) shows an alternate method for tuning whereby metallic or dielectric tuners are attached to three orthogonal sides and the metallic or dielectric elements protrude into the mono-block 10, as shown in FIG. 10(*b*). Tuning for only one block is shown in this figure. Tuning for the second block (the block on the left) would be similar. The tuning elements 80, 82, 84 can be metallic elements which are available from commercial sources. (See, for example, the metallic tuning elements available from Johanson Manufacturing, http://www.iohansonmfg.com/mte.htm#.) One could also use dielectric tuning elements, also available from commercial sources (again, see Johanson Manufacturing, for example).

The description above is focused mainly on the use of a triple-mode mono-block 10 in a filter. It should be understood that this disclosure also covers the use of the triple-mode mono-block filter as part of a multiplexer, where two or more filters are connected to a common port. One or more of the multiple filters could be formed from the triple-mode mono-blocks.

Input/Output

Input/Output: A proper method for transmitting a microwave signal into (input) and out of (output) the triple-mode mono-block filter is by the use of probes. The input probe excites an RF wave comprising of a plurality of modes. The corner cuts then couple the different modes. K. Sano and M. Miyashita, "Application of the Planar I/O Terminal to Dual-Mode Dielectric-Waveguide Filter," IEEE Trans. Microwave Theory Tech., pp. 2491–2495, December 2000, hereby incorporated by reference, discloses a dual-mode mono-block having an input/output terminal which functions as a patch antenna to radiate power into and out of the mono-block.

The method disclosed in the present invention is to form an indentation 90 in the mono-block (in particular, a cylindrical hole was used here), plate the interior of that hole 90 with a conductor (typically, but not necessarily, silver), and then connect the metallic surface to a circuit external to the filter/mono-block, as shown in FIG. 11. The form of the connection from the metallic plating to the external circuit can take one of several forms, as shown in FIG. 11 in which the interior or inner diameter of a hole or indentation is plated with metal (FIG. 11(*a*)). Next, an electrical connection 100 is fixed from the metal in the hole/indentation 90 to an external circuit, thus forming a reproducible method for transmitting a signal into or out of the triple-mode mono-block 10. In FIG. 11(*b*) a wire is soldered to the plating to form the electrical connection 100, in FIG. 11(*c*) a press-in connector 100 is used and in FIG. 11(*d*) the indentation is filled with metal including the wire 100.

Since the probe 100 is integrated into the mono-block 10, play between the probe and the block is reduced. This is an improvement over the prior art where an external probe 100 was inserted into a hole 90 in the block 100. Power handling problems occurred due to gaps between the probe 100 and the hole 90.

Integrated Filter Assembly Comprising a Preselect or Mask Filter, a Triple-Mode Mono-Block Resonator and a Low-Pass Filter Several features/techniques have been developed to make the triple-mode mono-block filter a practical device. These features and techniques are described below and form the claims for this disclosure.

Figure 12A:
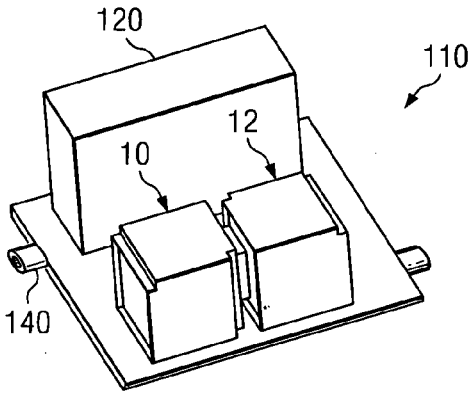
FIGS. 12*a* and 12*b* illustrate an assembly configuration in which the low pass filter is fabricated on the same circuit board that supports the mono-block filter and mask filter.
Figure 12B:
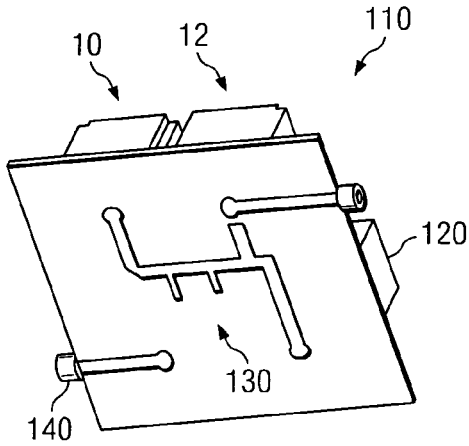

Filter Assembly: The novel and unobvious filter assembly 110 consisting of three parts, the mono-block resonator 10, premask (or mask) 120 and low-pass filters 130, can take one of several embodiments. In one embodiment, the thee filter elements are combined as shown in FIG. 12*a*, with connections provided by coaxial connectors 140 to the common circuit board. In this embodiment, the LPF 130 is etched right on the common circuit board as shown in FIG. 12*b*. The low pass filter 130 is fabricated in microstrip on the same circuit board that supports the mono-block filter 10, 12 and the mask 120 filter.

The low pass filter 130 shown in FIGS. 12*a* and 12*b* consist of three open-ended stubs and their connecting sections. The low pass filter 130 design may change as required by different specifications.

Figure 13:
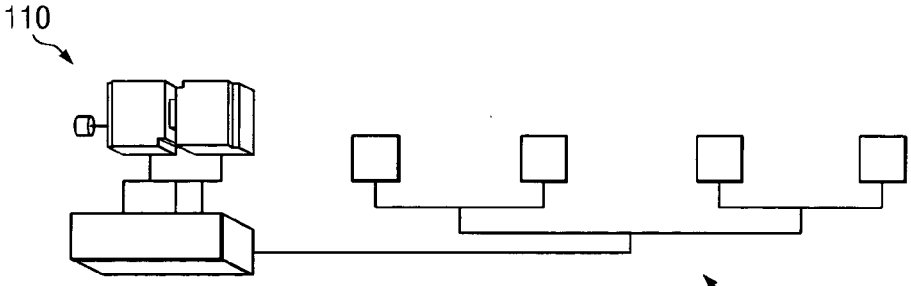
FIG. 13 illustrates an assembly in which the mono-block filter and combline filter are mounted to the same board that supports a 4-element antenna array.

In a second embodiment, the circuit board supporting the filter assembly 110 is an integral part of the circuit board that is formed by other parts of the transmit and/or receive system, such as the antenna, amplifier, or analog to digital converter. As an example, FIG. 13 shows the filter assembly 110 on the same board as a 4-element microstrip-patch antenna array 150. The mono-block filter 10, 12 and combline (or premask) filter 120 are mounted to the same board that supports a 4-element antenna array 150. The mono-block 10 and mask filters 120 are on one side of the circuit board. The low pass filter 130 and the antenna 150 are on the opposite side. A housing could be included, as needed.

Figure 14A:
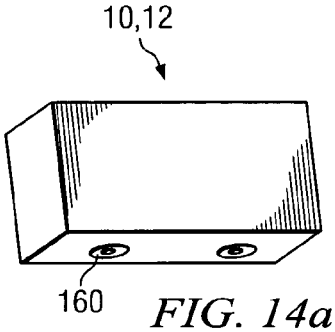
FIGS. 14*a, b* and *c* illustrate a mono-block filter packaged in a box (FIG. 14*a*), with internal features highlighted (FIG. 14*b*).
Figure 14B:
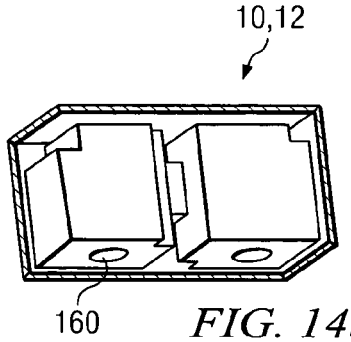
FIG. 14*c* shows a similar package for a duplexer.
Figure 14C:
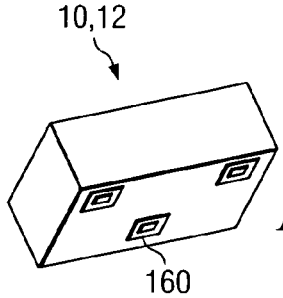

In a third embodiment, the filter assembly 110 is contained in a box and connectors are provided either as coaxial connectors or as pads that can be soldered to another circuit board in a standard soldering operation. FIG. 14 shows two examples of packages with pads 160. The filter package can include cooling fins if required. A package of the type shown in FIG. 14 may contain only the mono-block 10, 12, as shown, or it may contain a filter assembly 110 of the type shown in FIG. 13. FIG. 14(*a*) shows the mono-block filter 10, 12 packaged in a box with the internal features highlighted in FIG. 14(*b*). The pads 160 on the bottom of the box in FIG. 14(*a*) would be soldered to a circuit board. FIG. 14(*c*) shows a similar package for a duplexer consisting of two filters with one common port and, therefore, three connecting pads 160. A package of the type shown here may contain only the mono-block 10, 12 or it may contain a filter assembly 110.

Preselect or Mask Filter: Common to any resonant device such as a filter is the problem of unwanted spurious modes, or unwanted resonances. This problem is especially pronounced in multi-mode resonators like the triple-mode mono-block 10, 12. For a triple-mode mono-block 10, 12 designed for a pass band centered at 1.95 GHz, the first resonance will occur near 2.4 GHz. In order to alleviate this problem, we disclose the use of a relatively wide-bandwidth mask filter 120, packaged with the mono-block filter 10, 12.

Figure 15:
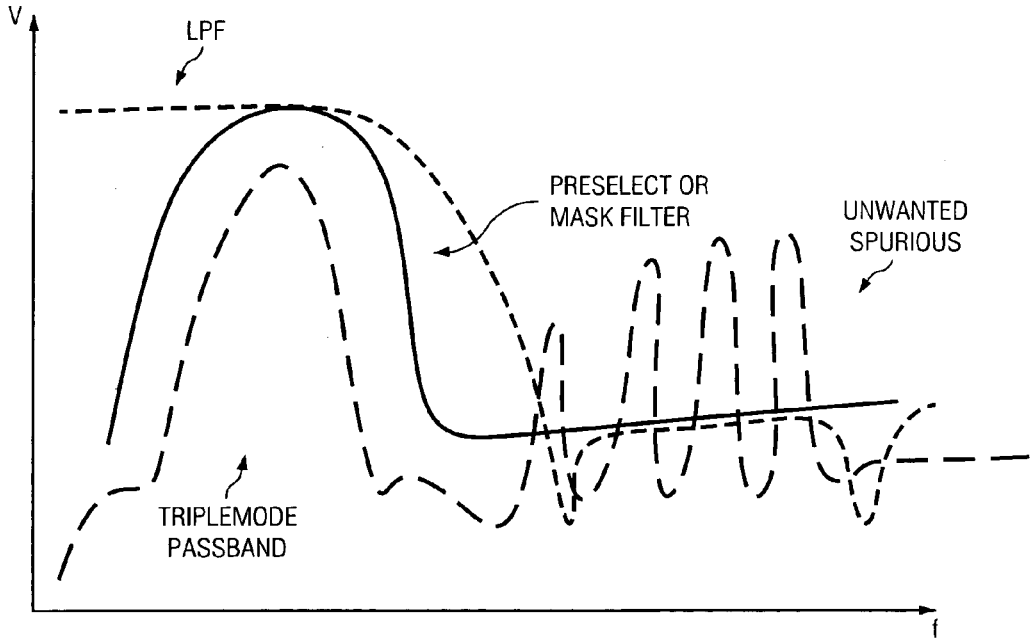
FIG. 15 illustrates the low-pass filter (LPF), the preselect or mask filter and the triple-mode mono-block passband response.

The premask filter 120 acts as a wide-bandwidth bandpass filter which straddles the triple-mode mono-block 10, 12 passband response. Its passband is wider than the triple-mode mono-block 10, 12 resonator's passband. Therefore, it won't affect signals falling within the passband of the triple-mode mono-block resonator 10, 12. However, it will provide additional rejection in the stopband. Therefore, it will reject the first few spurious modes following the triple-mode mono-block resonator's 10, 12 passband. See FIG. 15.

In example 1, a filter assembly was designed for 3G application. In a preferred embodiment, it is used in a Wideband Code Division Multiple Access (WCDMA) base station. It had an output frequency of about f0=2.00 GHz and rejection specification out to 12.00 GHz. The receive bandwidth is 1920 to 1980 MHz. The transmit bandwidth is 2110 to 2170 MHz. In the stopband for transmit mode, the attenuation needs to be 90 dB from 2110 to 2170 MHz, 55 dB from 2170 to 5 GHz and 30 dB from 5 GHz to 12.00 GHz. A preselect or mask filter 120 was selected with a passband from 1800 MHz to 2050 MHz and a 60 dB notch at 2110 MHz. Between 2110 MHz and 5 GHz it provides 30 dB of attenuation.

Figure 16A:
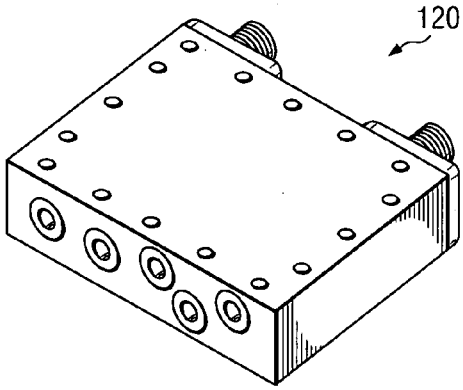
FIGS. 16*a* and *b* are photographs of the mask filter.
Figure 16B:
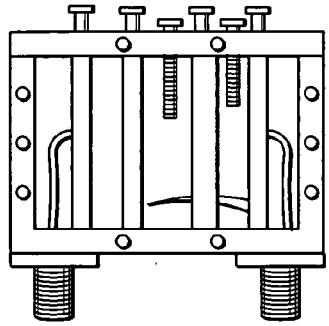

In example 1, the mask filter 120 has a 250 MHz bandwidth and is based on a 4-pole combline design with one cross coupling that aids in achieving the desired out-of-band rejection. A photograph of the mask filter 120 is shown in FIG. 16. FIG. 16(*a*) shows a 4-pole combline filter package. FIG. 16(*b*) shows the internal design of the 4 poles and the cross coupling. The SMA connectors shown in FIG. 16(*b*) are replaced by direct connections to the circuit board for the total filter package.

Low Pass Filter: It is common for a cellular base station filter specification to have some level of signal rejection required at frequencies that are several times greater than the pass band. For example, a filter with a pass band at 1900 MHz may have a rejection specification at 12,000 MHz. For standard combline filters, a coaxial low-pass filter provides rejection at frequencies significantly above the pass band. For the filter package disclosed here, the low pass filter 130 is fabricated in microstrip or stripline, and is integrated into (or etched onto) the circuit board that already supports and is connected to the mono-block filter 10, 12 and the mask filter 120. The exact design of the low pass filter 130 would depend on the specific electrical requirements to be met. One possible configuration is shown in FIGS. 12*a* and 12*b*.

Delay Filter

In another non-limiting, exemplary embodiment, a delay filter is provided that is designed for its flat, group delay characteristics. For example, but not by way of limitation, in this embodiment, the delay filter is not designed for any particular frequency rejection.

To achieve a flat group delay, it is necessary to have a prescribed cross-coupling scheme. For example, but not by way of limitation, in a six-pole filter, at least modes 1–2, 2–3, 3–4, 4–5 and 5–6 would be coupled. Further, prescribed cross-couplings are used to help meet certain frequency rejection specifications. In the case of the present embodiment, the cross couplings used to flatten the delay are 1–6 and 2–5 for a six-pole filter.

Figure 17A:
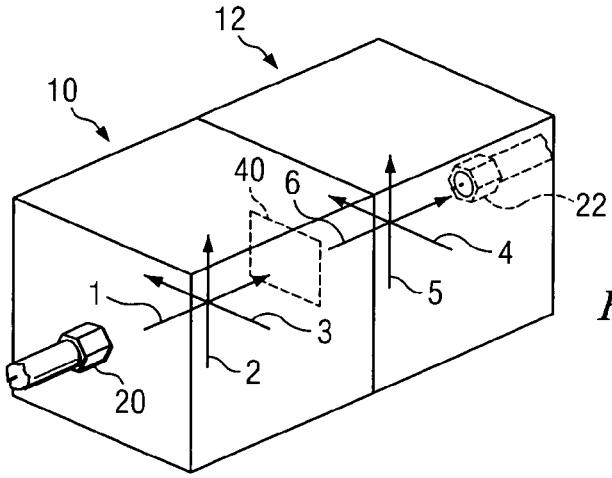
FIGS. 17(*a*) and (*b*) illustrate another preferred embodiment, including a triple-mode mono-block delay filter.
Figure 17B:
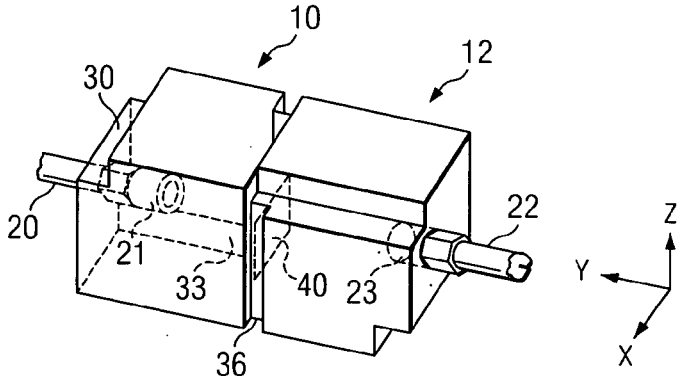

To implement the foregoing embodiment, a geometry as illustrated in FIGS. 17(*a*) and (*b*) is provided. In contrast to the embodiment of the present invention illustrated in FIG. 2, the input/output probes 20, 22 are positioned at the end faces of the assembly, rather than on the same side of the two blocks as illustrated in FIG. 2. As a result, positive cross-couplings between modes 1–6 and 2–5 are possible, whereas in the embodiment illustrated in FIG. 2, the 1–6 cross coupling is negative, and there is no 2–5 cross coupling. As a result, a flat group delay is possible in the preferred embodiment of the present invention.

As described in greater detail above, the triple-mode mono-block delay filter includes two triple-mode mono-block cavity resonators 10, 12. Each triple-mode mono-block resonator has three resonator modes in one block. The three types of resonant modes that are being used are the TM101, TE110, and TE011 modes, which are mutually orthogonal. In FIG. 17(*a*), modes 1 and 6 are TM101, modes 2 and 5 are TE110, and modes 3 and 4 are TE011. The electric field orientations of the six modes 1 . . . 6 are arranged in the directions shown in FIG. 17(*a*), so that equalized delay response of the filter can be achieved. For example, but not by way of limitation, the delay filter requires all positive couplings between modes 1 and 2, modes 2 and 3, modes 3 and 4, modes 4 and 5, modes 5 and 6, modes 1 and 6, modes 2 and 5.

An input/output probe e.g., 20 is connected to each metal plated dielectric block e.g., 10 to transmit the microwave signals. The coupling between resonant modes within each cavity is accomplished by the above-described corner cuts 30, 33, 36. Corner cuts are used to couple a mode oriented in one direction to a mode oriented in a second mutually orthogonal direction. There are two main corner cuts 30, 33 to couple the three resonant modes in each cavity, one oriented along the x-axis and one oriented along the y-axis. An aperture 40 between the two blocks 10, 12 is used to couple all six resonant modes 1 . . . 6 together between the cavities. The aperture 40 generates two inductive couplings by magnetic fields between two modes, and one capacitive coupling by electric fields. In addition, a third corner cut 36 along the z-axis can be used to cancel the undesired coupling among resonators. A wire frame view of the triple-mode mono-block delay filter is shown in FIG. 17(*b*) with the corner cuts 30, 33, 36 and the coupling aperture 40.

Figure 18A:
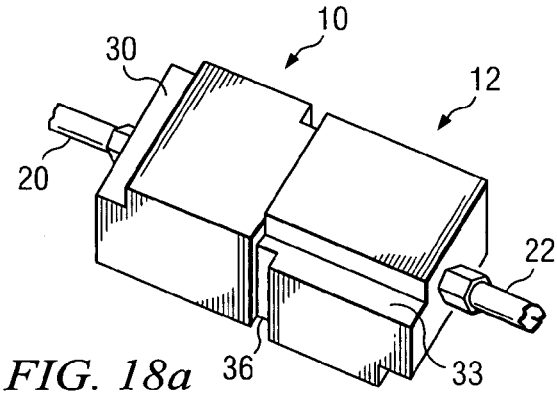
FIGS. 18(*a*) and (*b*) illustrate solid views of the triple-mode mono-block delay filter according to the present invention.
Figure 18B:
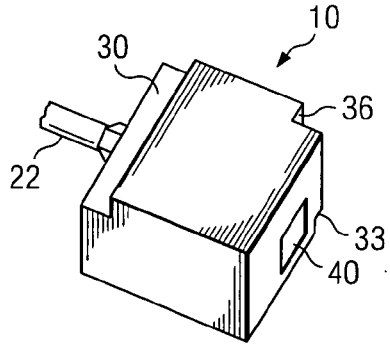

FIGS. 18(*a*) and (*b*) show the solid views of the two mono-blocks 10, 12 coupled to form a 6-pole delay filter. Corner cuts 30, 33, 36 are used to couple a mode oriented in one direction to a mode oriented in a second mutually orthogonal direction within a mono-block cavity. Each coupling represents one pole in the filter's response. Therefore, one triple-mode mono-block discussed above represents the equivalent of three poles or three electrical resonators. FIG. 17(*b*) and FIG. 18 show the third corner cut 36 that provides a cross coupling between modes 1 and 3, modes 4 and 6 in the filter. By the appropriate choice of the particular block edge for this corner cut, either positive or negative cross coupling is possible. The third corner cut 36 can be used to improve the delay response of the filter, or cancel the unwanted parasite effects within the triple-mode mono-block filter.

Figure 19:
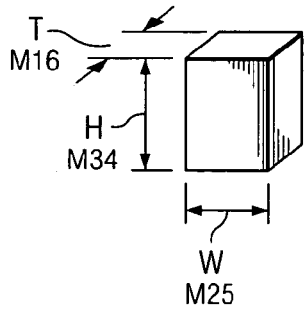
FIG. 19 illustrates a function of an aperture in the delay filter according to the present invention.

The aperture 40 performs the function of generating three couplings among all six resonant modes for delay filter, instead of two couplings for the regular bandpass filter. The aperture 40 generates two inductive couplings by magnetic fields between modes 3 and 4, modes 2 and 5; and one positive capacitive coupling by electric fields between modes 1 and 6, as shown in FIG. 19. Adjusting aperture height H will change the coupling M34 most, and adjusting aperture width W will change the coupling M25 most. Similarly, changing the aperture's thickness T can adjust the coupling M16 which is coupled by electric fields.

Figure 20:
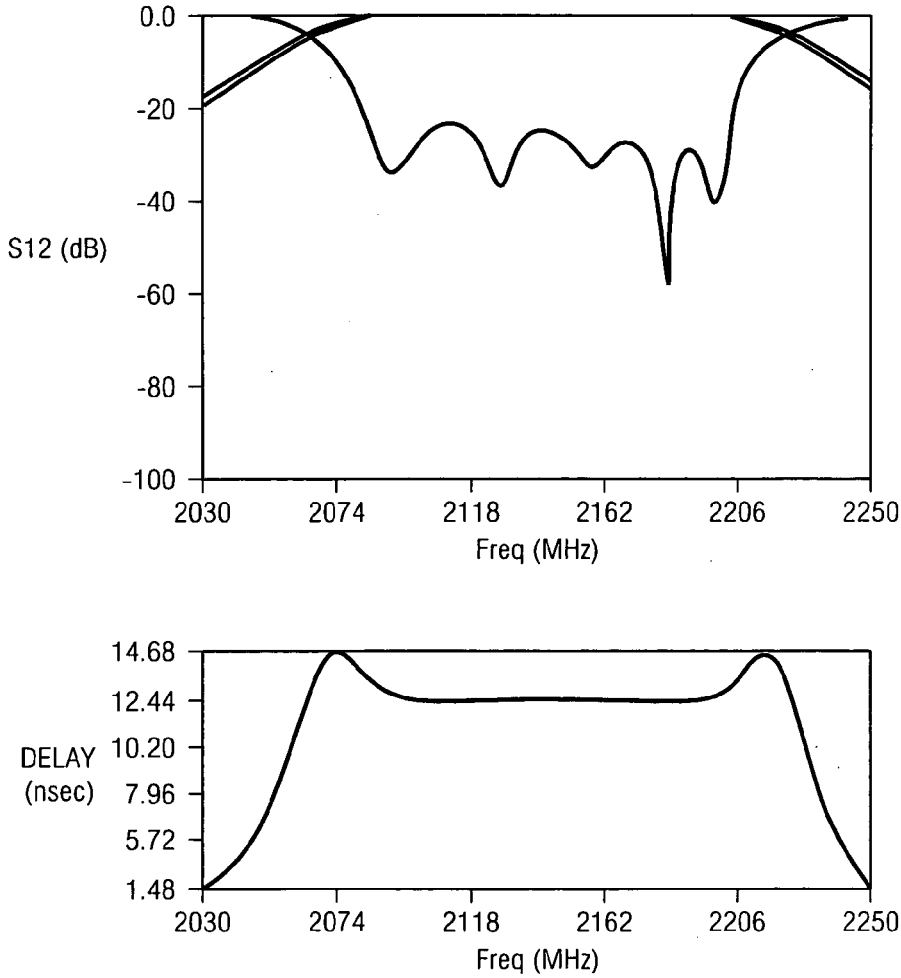
FIG. 20 illustrates simulated frequency responses of the triple-mode mono-block delay filter according to this preferred embodiment of the present invention.

FIG. 20 shows the simulated frequency responses of the triple-mode mono-block delay filter at center frequency of 2140 MHz by HFSS 3D electromagnetic simulator. The filter has over 20 dB return loss and very flat group delay over wide frequency range.

While the invention has been disclosed in this patent application by reference to the details of preferred embodiments of the invention, it is to be understood that the disclosure is intended in an illustrative, rather than a limiting sense, as it is contemplated that modifications will readily occur to those skilled in the art, within the spirit of the invention and the scope of the appended claims and their equivalents.

What is claimed is:

1. A filter having a flat group delay, comprising:

first and second triple-mode mono-blocks each having opposing first and second faces thereof, wherein said first and second triple-mode mono-blocks are coupled together via respective openings in the first face of said first triple-mode mono-block and the second face of said second triple-mode mono-block; and a first probe positioned at the second face of said first triple-mode mono-block and a second probe positioned at the first face of said second triple-mode mono-block, wherein each of the triple modes in said first mono-block is coupled to a different one of the triple modes in said second mono-block via the openings.

2. The filter of claim 1, wherein said openings generates two inductive couplings between two modes by magnetic field, and said openings generates one capacitive coupling by an electric field.

3. The filter of claim 1, wherein said first triple-mode mono-block and said second triple-mode mono-block each comprises a metal plated dielectric block.

4. The filter of claim 1, wherein at least two of the modes in said first mono-block which are coupled to a different one of the modes in said second mono-block are coupled in a common polarity.

5. The filter of claim 4, wherein said common polarity is positive.

6. The filter having a flat group delay as claimed in claim 1, further comprising:

at least one corner cut on a respective corner of one or both of said first and second triple-mode mono-blocks.

7. The filter having a flat group delay as claimed in claim 6, wherein said at least one corner is rectangular shaped.

8. The filter of claim 1, wherein said first triple-mode mono-block and said second triple-mode mono-block are each cut along a first corner in a first axis and along a second, mutually orthogonal corner in a second axis to generate said coupling via said openings.

9. The filter of claim 8, further comprising a third cut on said first triple-mode mono-block and on said second triple-mode mono-block, made along a corner in a third axis to cancel undesired coupling.

* * * * *